US012326327B2

(12) United States Patent
Gaide

(10) Patent No.: US 12,326,327 B2
(45) Date of Patent: Jun. 10, 2025

(54) AMMUNITION CARTRIDGE

(71) Applicant: Rabuffo SA, Monnaz (CH)

(72) Inventor: Albert Gaide, Monnaz (CH)

(73) Assignee: Rabuffo SA, Monnaz (CH)

( * ) Notice: Subject to any disclaimer, the term of this patent is extended or adjusted under 35 U.S.C. 154(b) by 0 days.

(21) Appl. No.: 18/664,466

(22) Filed: May 15, 2024

(65) Prior Publication Data

US 2024/0310151 A1 Sep. 19, 2024

Related U.S. Application Data

(62) Division of application No. 17/802,176, filed as application No. PCT/EP2021/054525 on Feb. 24, 2021, now abandoned.

(30) Foreign Application Priority Data

Feb. 27, 2020 (EP) ..... 20159923

(51) Int. Cl.
*F42B 10/48* (2006.01)
*F42B 5/02* (2006.01)
(Continued)

(52) U.S. Cl.
CPC ..... *F42B 5/025* (2013.01); *F42B 5/16* (2013.01); *F42B 8/12* (2013.01); *F42B 10/48* (2013.01)

(58) Field of Classification Search
CPC ..... F42B 10/32; F42B 10/48; F42B 10/50; F42B 10/56; F42B 10/58
See application file for complete search history.

(56) References Cited

U.S. PATENT DOCUMENTS 4,241,660 A * 12/1980 Donovan ..... F42B 10/48 102/517
4,245,556 A * 1/1981 Donovan ..... F42B 10/48 102/490

(Continued)

FOREIGN PATENT DOCUMENTS

AT 517688 B1 4/2017
CA 3083853 A1 6/2019

(Continued)

OTHER PUBLICATIONS

International Preliminary Report on Patentability received for PCT Patent Application No. PCT/EP2021/054525, mailed on Sep. 9, 2022, 10 pages.

(Continued)

*Primary Examiner* — Jonathan C Weber
(74) *Attorney, Agent, or Firm* — Faegre Drinker Biddle & Reath LLP

(57) ABSTRACT

Ammunition cartridge including a rigid casing including a tubular sleeve and a base closing an end of the casing, a projectile mounted at another end of the casing, a propellant charge contained inside the casing, and an ignition device. The projectile includes a solid material body having a volume V1 extending between a tip to a trailing end, wherein the projectile further includes a cavity that extends into the body from the trailing end, a volume V2 of the cavity being at least fifteen percent (15%) of a combined volume V1+V2 of the projectile solid material and cavity: V2>0.15×(V1+V2).

18 Claims, 16 Drawing Sheets

(51) Int. Cl.
*F42B 5/16* (2006.01)
*F42B 8/12* (2006.01)

(56) References Cited

U.S. PATENT DOCUMENTS

| | | | | |
|---|---|---|---|---|
| 4,297,948 | A * | 11/1981 | Donovan | F42B 10/48 102/501 |
| 4,413,566 | A | 11/1983 | Loeb et al. | |
| 4,572,077 | A | 2/1986 | Antoine et al. | |
| H770 | H | 4/1990 | Kline et al. | |
| 5,001,986 | A | 3/1991 | Meister | |
| 5,148,750 | A | 9/1992 | Becker et al. | |
| 9,121,679 | B1 | 9/2015 | Kim et al. | |
| 9,157,713 | B1 | 10/2015 | Peterson et al. | |
| 9,952,024 | B2 * | 4/2018 | Sullivan | F42B 10/48 |
| 11,143,493 | B2 | 10/2021 | Gaide | |
| 2011/0308417 | A1 | 12/2011 | Glasser | |
| 2014/0230684 | A1 | 8/2014 | Krauss et al. | |
| 2016/0131465 | A1 | 5/2016 | Harrison | |
| 2017/0299351 | A1 | 10/2017 | Baxter et al. | |
| 2020/0025535 | A1 | 1/2020 | Binek et al. | |
| 2020/0116463 | A1 | 4/2020 | Harrison | |
| 2020/0158480 | A1 | 5/2020 | Routhier et al. | |
| 2020/0386526 | A1 | 12/2020 | Gaide | |
| 2022/0107163 | A1 | 4/2022 | Gaide | |
| 2023/0103829 | A1 | 4/2023 | Gaide | |

FOREIGN PATENT DOCUMENTS

| | | | | |
|---|---|---|---|---|
| EP | 2543954 | A1 | 1/2013 | |
| EP | 3117177 | B1 * | 8/2019 | F42B 10/48 |
| GB | 2106618 | A | 4/1983 | |
| GB | 2530908 | A | 4/2016 | |
| GB | 2602049 | A * | 6/2022 | F42B 10/00 |
| WO | WO-2015183371 | A2 * | 12/2015 | F42B 10/48 |
| WO | 2016/076940 | A2 | 5/2016 | |
| WO | 2018/037352 | A1 | 3/2018 | |
| WO | 2019/110614 | A1 | 6/2019 | |

OTHER PUBLICATIONS

International Search Report and Written Opinion received for PCT Patent Application No. PCT/EP2021/054525, mailed on May 25, 2021, 16 pages.

* cited by examiner 24
4
16
25
14
L
D
6
12
4
25
16
14
12

PROJ. 75% / INI-VOL 108% / PROP 100%

PROJ. 75% / INI-VOL 108% / PROP. 108%

PROJ. 75% / INI-VOL 108% / PROP. 108% / SP-ENER 115%

PROJ. 69% / INI VOL 110% / PROP 100% / SP-ENER 100%

PROJ. 69% / INI VOL 110% / PROP 110% / SP-ENER 118%

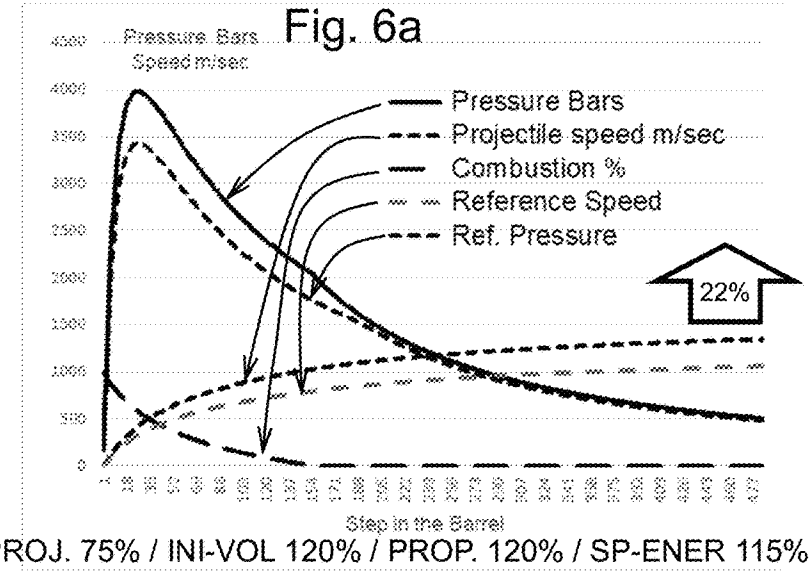
PROJ. 75% / INI-VOL 120% / PROP. 120% / SP-ENER 115%
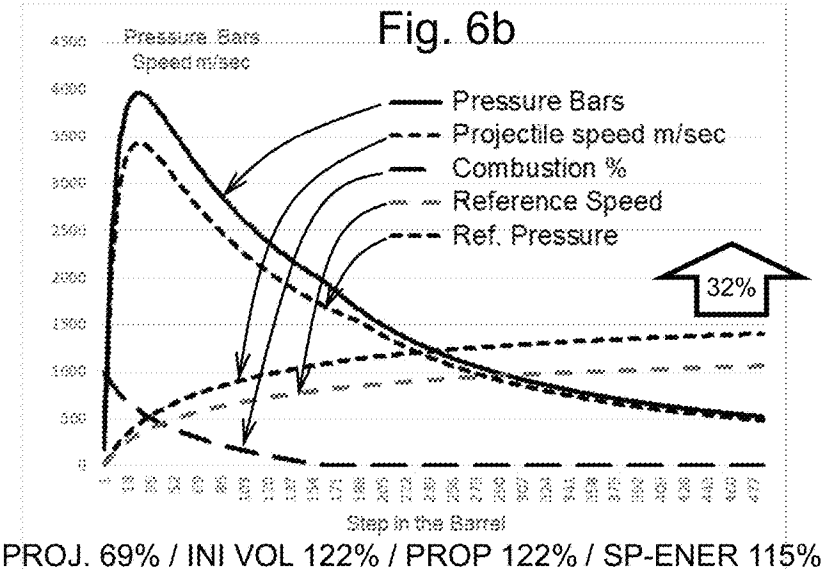
PROJ. 69% / INI VOL 122% / PROP 122% / SP-ENER 115%

AMMUNITION CARTRIDGE

CROSS-REFERENCE TO RELATED APPLICATIONS

The present application is a divisional of U.S. patent application Ser. No. 17/802,176, filed Aug. 25, 2022, which is a national stage entry of International (PCT) Patent Application Number PCT/EP2021/054525, filed Feb. 24, 2021, which claims priority to European Patent Application Number 20159923.0, filed Feb. 27, 2020, the complete disclosures of which are expressly incorporated herein by reference.

FIELD OF THE INVENTION

This invention relates to an ammunition cartridge for rifles and firearms.

BACKGROUND OF THE INVENTION

Conventional ammunition cartridges for firearms and guns of various sizes and purposes typically comprise a deep drawn brass or steel casing containing a propellant charge in the form of powder or granules of a combustible substance, and a projectile assembled in a gripping fit at an open tubular sleeve end of the casing. Most projectiles are massive, cylindrical objects with an aerodynamic tip at the front and a flared shape with a flat base at the rear. The latter is usually mounted inside the cartridge casing whereas the aerodynamical tip is outside the cartridge casing.

The propellant's combustion and its release of a large quantity of gas pushes the projectile through the barrel providing it with substantial kinetic energy. The relationship between combustion, gas pressure and projectile velocity may be modelled computationally, as per se known and illustrated in FIG. 7. This per se known model shows that combustion occurs approximately in the first third of the barrel, that maximum pressure occurs approximately in the first tenth of the barrel and that acceleration of the projectile occurs substantially in the first half of the barrel. These relations depend principally on the weight of the projectile, the quantity of propellant, its specific combustion energy and the initial volume in which the combustion starts. The combustion volume increases as the projectile moves into the barrel but is has been shown by model calculations, as well as experimental measurements, that the maximum pressure produced by the combustion is very much dependent on the initial combustion volume, i.e. the internal volume of the cartridge before ignition.

Considering that the pressure tolerance of most weapons is set at about 4'000 bars and that the cartridge internal volume is also specified by the weapons geometry, the propellant's specific energy and its weight have long been optimized in order to provide the largest velocity for every specific projectile mass. Any change in the propellant's specific energy or its quantity leads to an unacceptable overpressure.

The pressure generated by combustion of the propellant substance must not exceed a certain level in order to prevent damage to the weapon. In many conventional weapons the pressure generated by the combusting propellant should not exceed around 4000 bars. This limits the propulsion force that the propellant charge can impart.

Another major concern with modern ammunition is related to the range of the projectile. Increasing the projectile range is a high requirement as this sets the distance at which the enemy can be held. High ranges pause however serious problems when it comes to training and security of shooting ranges. In such cases it is highly desirable that the projectile's flight is limited to a much shorter distance than the one it can cover. Desired training projectiles are expected to lose their stability at a certain point of their trajectory and consequently interrupt their flight.

SUMMARY OF THE INVENTION

In view of the foregoing, it is an object of the invention to provide an ammunition cartridge with improved performance, in particular that allows to generate a high and well controlled acceleration of the projectile without exceeding the chamber pressure tolerance, and that is safe to use.

It is another object of the invention to provide an ammunition cartridge that is suitable for training purposes by limiting voluntarily the range of the projectile.

It is advantageous to provide an ammunition cartridge that is economical to manufacture in large quantities.

It is advantageous to provide an ammunition cartridge that is light, compact, and uses less materials for a given performance.

It is advantageous to provide improved ammunition cartridges that can be used in existing weapons.

Objects of this invention have been achieved by providing the ammunition cartridge according to claim 1.

Dependent claims recite various advantageous features or variants.

Disclosed herein, is an ammunition cartridge comprising a rigid casing including a tubular sleeve and a base closing an end of the casing, a projectile mounted at another end of the casing, a propellant charge contained inside the casing, and an ignition device. The projectile comprises a solid material body having a volume V1 extending between a tip to a trailing end wherein the projectile further comprises a cavity that extends into the body from the trailing end, a volume V2 of the cavity being at least fifteen percent (15%) of a combined volume V1+V2 of the projectile solid material and cavity: $V2>0.15\times(V1+V2)$, and the volume V2 of the cavity is less than forty percent (40%) of the combined volume of the projectile solid material and cavity: $V2<0.4\times(V1+V2)$.

According to an aspect of the invention, the casing is made of at least two parts including a base and a tubular sleeve that are assembled together, preferably welded together. The tubular sleeve may advantageously be made of stainless steel, and preferably the base is also made of stainless steel.

According to an aspect of the invention, the present invention is particularly advantageous for ammunition having a length of the casing relative to an outer maximum diameter of the casing (casing tubular sleeve) in a range of 4.5 to 7 and a depth of the cavity from the trailing end is preferably in a range of 1 to 3 calibers.

In an advantageous embodiment, the volume V2 of the cavity is at least twenty percent (20%) of the combined volume V1+V2 of the projectile solid material and cavity: $V2>0.20\times(V1+V2)$.

In an advantageous embodiment, the volume V2 of the cavity is less than thirty percent (30%) of the combined volume V1+V2 of the projectile solid material and cavity: $V2<0.30\times(V1+V2)$.

In an advantageous embodiment, the depth of the cavity from the trailing end is at most 2.5 calibers.

In an advantageous embodiment, the depth of the cavity from the trailing end is at least 1.5 calibers.

In an advantageous embodiment, the propellant fills an inside of the casing and extends at least partially into the cavity of the projectile. The propellant may be in the form of loose granules or powder, or in a solid pre-form.

In an advantageous embodiment, the tubular sleeve is made of a sheet of metal rolled into a tube and welded along a seam.

In a variant, the tubular sleeve is made of an extruded tube of metal.

According to yet another aspect of the invention, the projectile comprises a flight destabilizing device comprising a consumable material mounted in the cavity and configured to deplete as the projectile flies thus offsetting a centre of gravity (CG) of the projectile from a centre longitudinal axis (A) of the projectile.

In an embodiment, the consumable material comprises or consists of a pyrotechnically active material.

In an embodiment, the consumable material is mounted in a recess in an end wall of the cavity, the recess being asymmetrically disposed with respect to the longitudinal centre axis (A).

In an embodiment, the consumable material comprises an additional layer arranged around the longitudinal centre axis in such a manner that the centre of gravity (CG) of the projectile remains on its centre longitudinal axis even as the additional layer is thinned as it is being consumed.

In an embodiment, the projectile comprises a flight destabilizing device mounted in the cavity, comprising a consumable material and an explosive charge, the consumable material configured to deplete as the projectile flies until such time where it ignites the explosive charge to destabilize the projectile.

In an embodiment, the projectile comprises a flight destabilizing device mounted in the cavity, comprising an explosive charge, ignited by an electric ignition device comprising a conductive coil configured to induce an electric current in the presence of a magnetic field to detonate said explosive charge.

Further objects and advantageous aspects and embodiments of the invention will be apparent from the claims, and from the following detailed description and accompanying figures.

BRIEF DESCRIPTION OF THE DRAWINGS

The invention will now be described with reference to the accompanying drawings, which by way of example illustrate embodiments of the present invention and in which.

FIGS. 6*a*-6*b* are graphical representations of the pressure, velocity and combustion profiles of a simulated combustion process with a two part stainless steel casing and a projectile having a cylindrical cavity of 25% (FIG. 6*a*) and 31% (FIG. 6*b*) of its nominal volume according to an embodiment of the invention;

FIG. 9*c* FIG. 9*a* illustrates a plot of velocity change versus an increase in cartridge internal volume according to an embodiment of the invention compared to conventional ammunition cartridges with brass casings and for different propellant filling levels;

DETAILED DESCRIPTION OF EMBODIMENTS OF THE INVENTION

Figure 1:
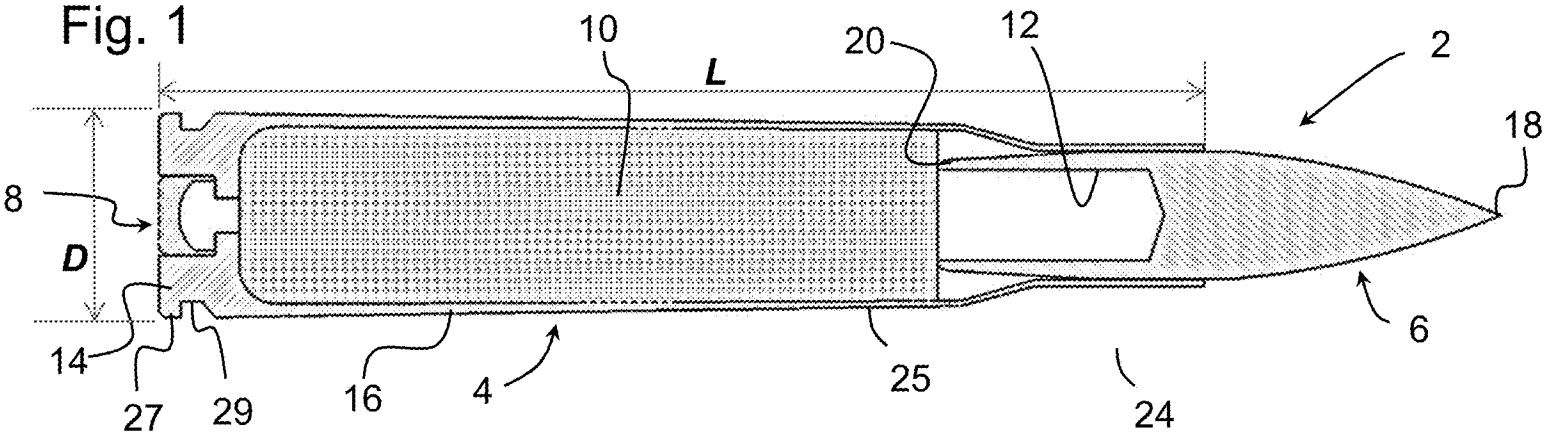
FIG. 1 is a schematic cross-sectional view of an ammunition cartridge according to a first embodiment of the invention.

Referring to FIG. 1, an ammunition cartridge comprises a casing 4, a projectile 6, an ignition device 8, and a propellant charge 10. The projectile 6 may have various materials and geometric properties that are per se known in the field of ammunition cartridges and has a diameter defining a caliber configured for a barrel of a weapon. The casing diameter D and length L are dependent on the loading chamber of the weapon it is intended for use with. The ammunition cartridge outer shape and dimensions may advantageously be configured to conform to a standard size for use with existing firearms and rifles, in replacement of existing ammunition cartridges.

The casing 4 generally has a cylindrically shaped tubular sleeve 16 closed at one end by a base 14 housing an ignition device 8, and at the other end of the casing the projectile 6 is fitted. The projectile receiving end, as is well-known in the art, comprises a neck portion 24 connected via a tapered portion to a major portion 25 of the tubular sleeve portion containing the propellant charge 10, the neck portion 24 having a smaller diameter than the major portion 25. The outer shape of the base may have various configurations depending on the weapon with which it is intended to be used, and may for instance typically comprise a rim 27 and annular groove 29 that serve to eject the casing from the firing chamber of the weapon as is per se well-known in the art.

Figure 2:
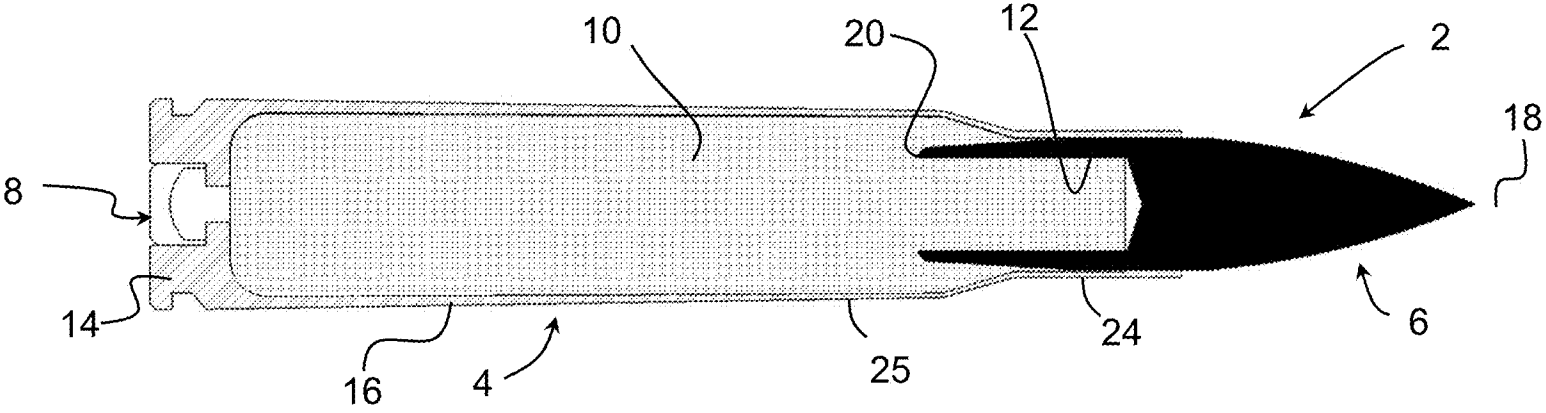
FIG. 2 is a schematic cross-sectional view of an ammunition cartridge similar to FIG. 1*a* but of a variant.

In a first embodiment, the casing 4 may be made of a single piece part, namely formed from a single piece of material such as a conventional brass ammunition casing, for instance as illustrated in FIGS. 1 and 2.

Figure 13:
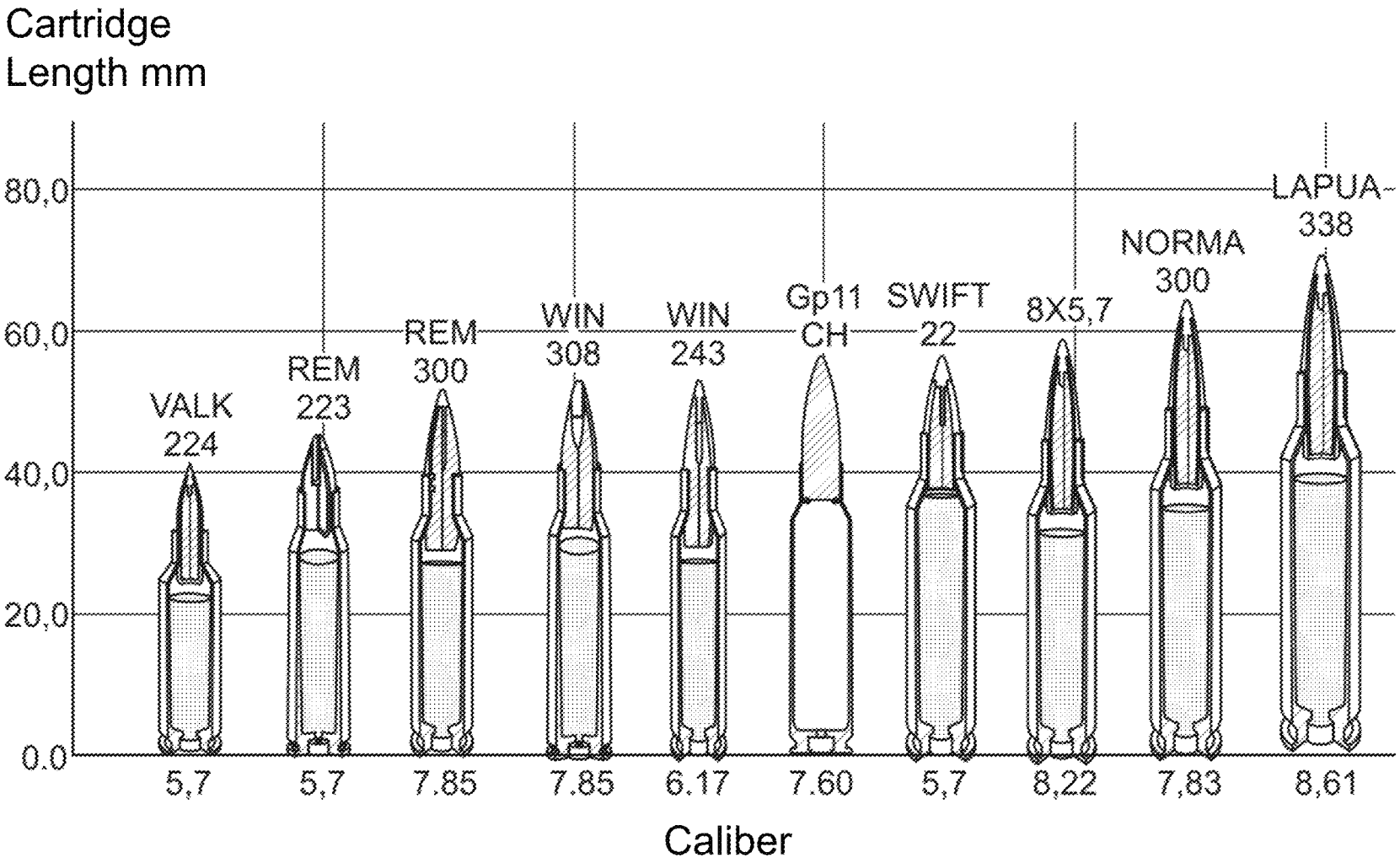
FIG. 13 is an illustration of various conventional common caliber cartridges, showing the length of the cartridges, all these cartridges provided with conventional brass casings.

The present invention is in particular adapted for long ammunition used for rifles, for instance ammunition types as illustrated in FIG. 13. The ratio L/D of length L to maximum diameter D of the casing for such ammunition is in a range of 4.5 to 7 (four and a half to seven), preferably in a range of 5 to 7 (five to seven).

Figure 3:
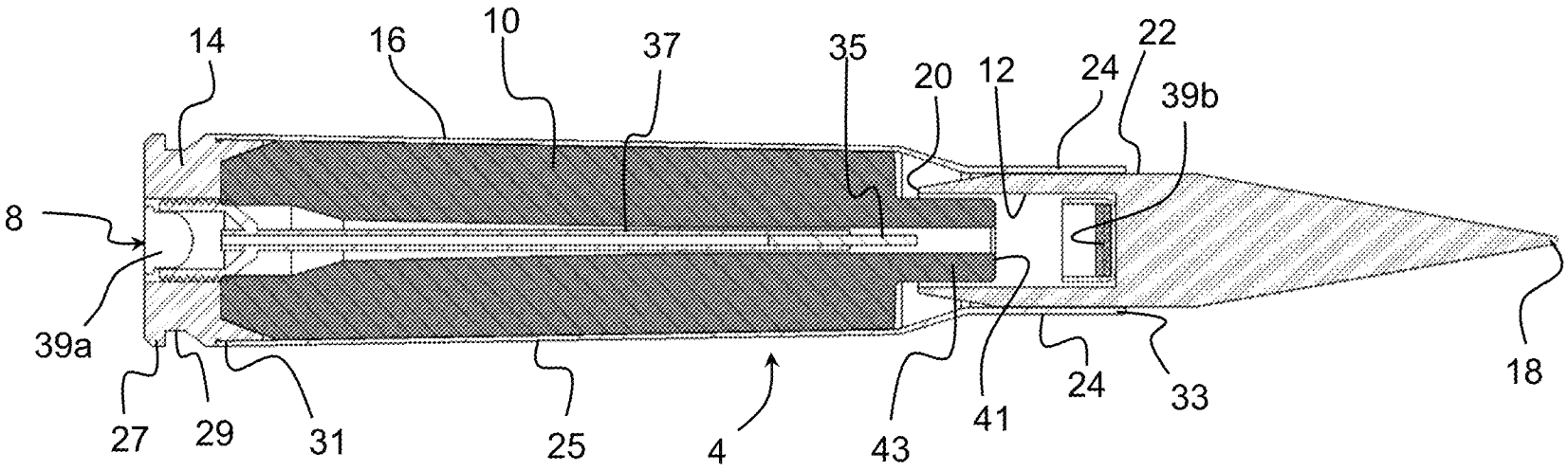
FIG. 3 is a schematic cross-sectional view of an ammunition cartridge according to a second embodiment of the invention.
Figures 3A, 3B, 3C:
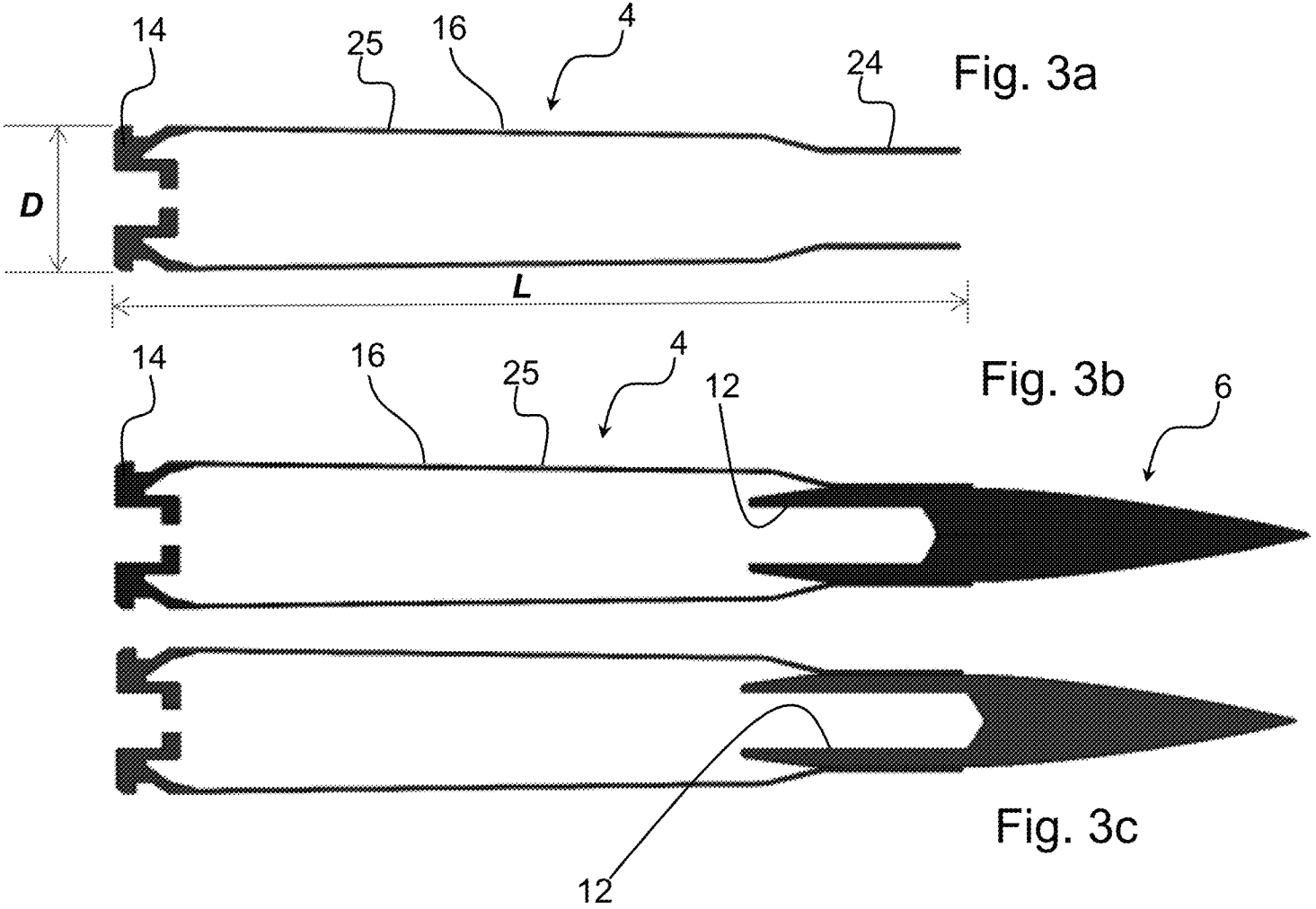
FIG. 3*a* is a cross-sectional view of a stainless steel two-part casing for the cartridge of FIG. 3.
FIGS. 3*b* and 3*c* are similar to FIG. 3*a* with projectiles mounted in the casing with different sized cavities.

According to an aspect of the invention, the casing may be assembled from two or more parts, as illustrated in FIG. 3, with at least a cylindrical body or sleeve 16 and a base 14, that are assembled together by welding, soldering, or crimping. The latter embodiment allows assembly of the propellant charge 10 into the casing tubular sleeve from the base end 31 before assembly of the base 14 to the tubular sleeve 16, or in a conventional manner from the open neck end 33 once the multi-part casing is assembled. The casing is preferably made of steel, whereby the tubular sleeve 16 may be made from sheet metal, rolled into a tube and welded along an axial seam. The tubular sleeve may also be extruded. The tubular sleeve is preferably welded to the stainless steel base 14.

The propellant charge 10 may be in the form of powder or granules as per se known in the art. The embodiment illustrated in FIGS. 2*a* to 2*c* comprises a propellant charge in the form of powder or granules.

In another embodiment, the propellant charge is bound in a preform that forms a solid body insertable into the tubular sleeve 16 of the casing 4. The preform may comprise a combustible substance bound together with a binding material. The embodiment illustrated in FIG. 3 comprises a propellant charge bound in a solid preform.

In an embodiment, as illustrated in FIGS. 1 and 2, the ignition device 8 is fully mounted in the base 14 and ignites the propellant 10 at the end distal from the projectile 6, in a manner widely known in conventional ammunition cartridges.

In another embodiment, the ignition device 8 is configured to ignite the propellant 10 at a position distal from the base 14 and proximate the projectile 6. Ignition of the propellant charge 10 at a position proximate the projectile 6 may be achieved in various manners.

In an embodiment as schematically illustrated in FIG. 3, the ignition device comprises a transmission pin 35 slidably mounted in a guide channel 37 extending from the base 14 to a position proximate the projectile 6. A first ignition charge 39*a* positioned in the base 14 of the cartridge may be ignited by a firing pin or hammer of the weapon deforming the ignition cap, similar to a conventional ammunition cartridge ignition process, whereby in this variant the guide channel 37 channels the pressure of expanding gas generated by combustion of the ignition charge 39*a* to propel the transmission pin 35 towards a base wall of the projectile on which a second ignition charge 39*b* is positioned and is ignited by impact of the transmission pin thereagainst. Combustion of the second ignition charge ignites the leading end 41 of the propellant 10 facing and proximate the projectile 6.

The projectile 6 extends from a pointed tip 18 to a trailing end 20. A centre portion of the projectile comprises a cylindrical shape that is coupled in a tight friction fit to the neck portion 24 of the casing. The outer diameter of the trailing end is less than the centre body portion 22, as per se known, inter alia to facilitate insertion assembly of the projectile into the casing 4.

According to an aspect of the invention, the projectile 6 comprises a cavity 12 that extends into the body of the projectile from the trailing end 20, the volume of the cavity 12 being at least fifteen percent (15%), preferably at least twenty percent (20%), for instance around twenty five percent (25%), but less than fifty percent (50%), of the combined volume of the projectile solid material (V1) and cavity (V2):

$$V2 > 0,15 \times +(V1 + V2), \text{ preferably } V2 > 0,2 \times (V1 + V2)$$

$$V2 < 0.5 \times (V1 + V2), \text{ preferably } V2 < 0.4 \times (V1 + V2)$$

The combined volume of the projectile solid material (V1) and cavity (V2) is also referred to herein as the "nominal" volume of the projectile (i.e. the volume of a conventional projectile without cavity), and the nominal mass of the projectile corresponds to the mass of the nominal volume of projectile material.

Advantageously, the cavity 12 formed into the body of the projectile with the aforementioned dimensions increases the initial combustion volume and thus allows increasing the propellant quantity and its released energy without exceeding the maximum pressure tolerance (set at about 4'000 bars). The increase in combustion volume also allows providing a propellant with a higher specific energy. More kinetic energy can thus be transferred to the projectile.

Another advantage of the cavity as described above is the shift of the centre of gravity CG of the projectile towards the centre of pressure CP acting on the projectile as it displaces in air, thus providing greater stability.

Simulations and experiments have shown that the maximal pressure generated by the combustion of the propellant is very much dependant on the size of the initial volume, i.e. the volume in which the propellant starts its gas generating combustion.

FIGS. 4*a* to 6*b* illustrate the benefits of the present invention in the exemplary cases of projectiles with cavities forming 25% and 31% of the nominal volume of the projectile.

Figure 4A:
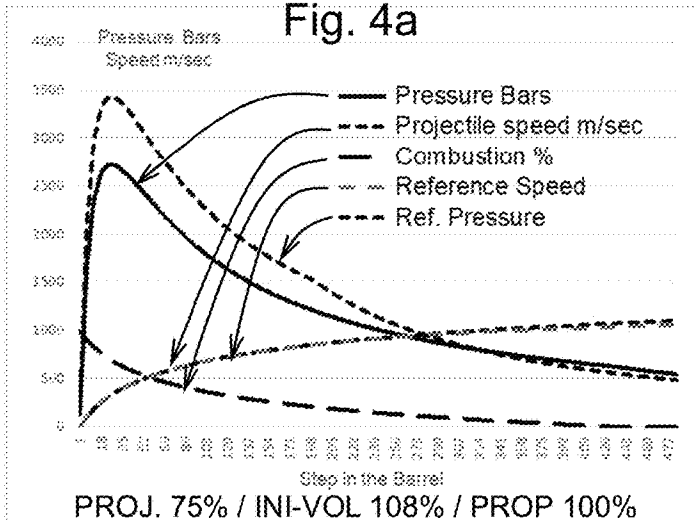
FIGS. 4*a*-4*c* are graphical representations of the pressure, velocity and combustion profiles of a simulated combustion process with a projectile having a cylindrical cavity of 25% of its nominal volume according to an embodiment of the invention.
Figure 4B:
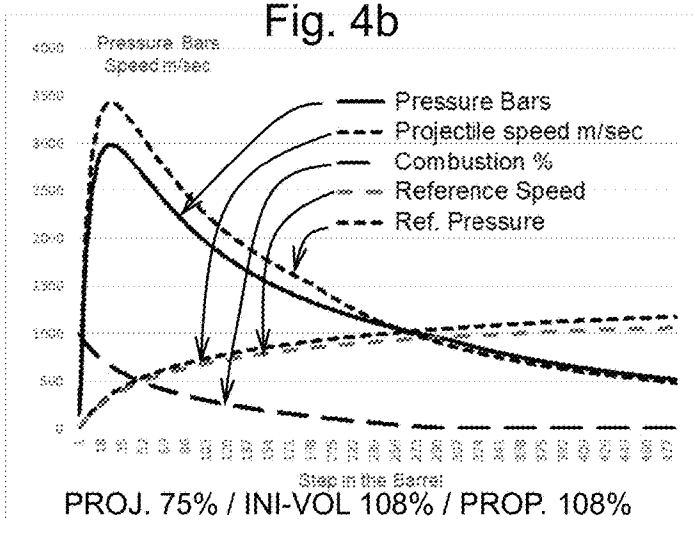
Figure 4C:
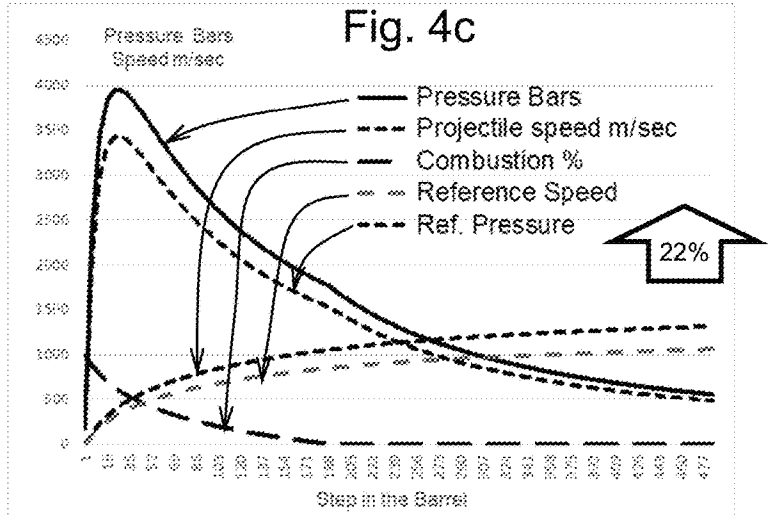

In FIG. 4*a*, the simulation model, which refers to a projectile mass of 75% of the nominal projectile mass, shows a substantial maximum pressure drop to about 2'700 bars down from about 3'500 bars. The cavity portion of the projectile offers however an additional volume of about 8% of the internal casing volume. One can consequently increase the quantity of propellant by 8% and take advantage of the fact that the initial combustion volume has also increased by 8%. The resulting maximum pressure remains however below the 4'000 bars weapon tolerance as shown in FIG. 4*b*. Room is left for an increase in the propellant's specific energy by about 15% with an increase of the maximum pressure to about 4'000 bars as shown in FIG. 4*c*. It is important to note that the projectile velocity has increased by about 24% and its kinetic energy has increased by about 15%.

Figure 5A:
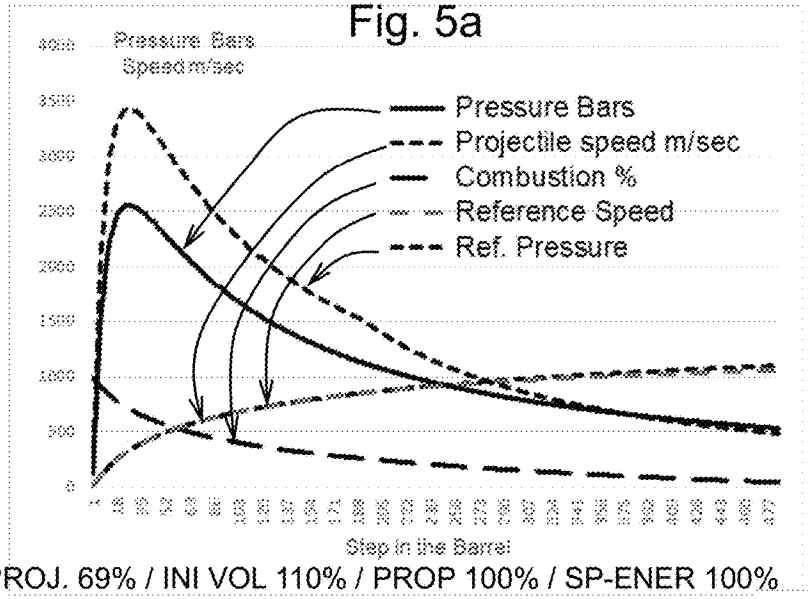
FIGS. 5*a*-5*b* are graphical representations of the pressure, velocity and combustion profiles of a simulated combustion process with a projectile having a cylindrical cavity of 31% of its nominal volume according to an embodiment of the invention.
Figure 5B:
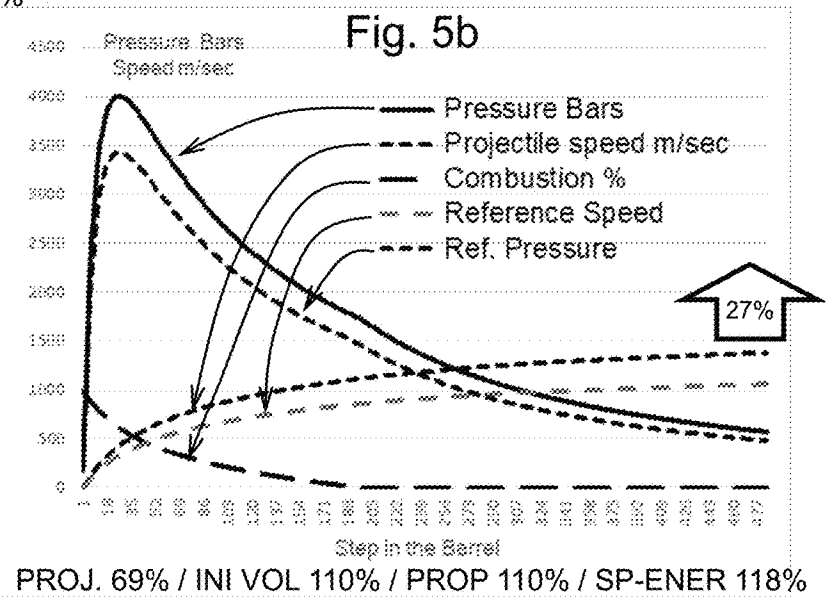
Figure 7:
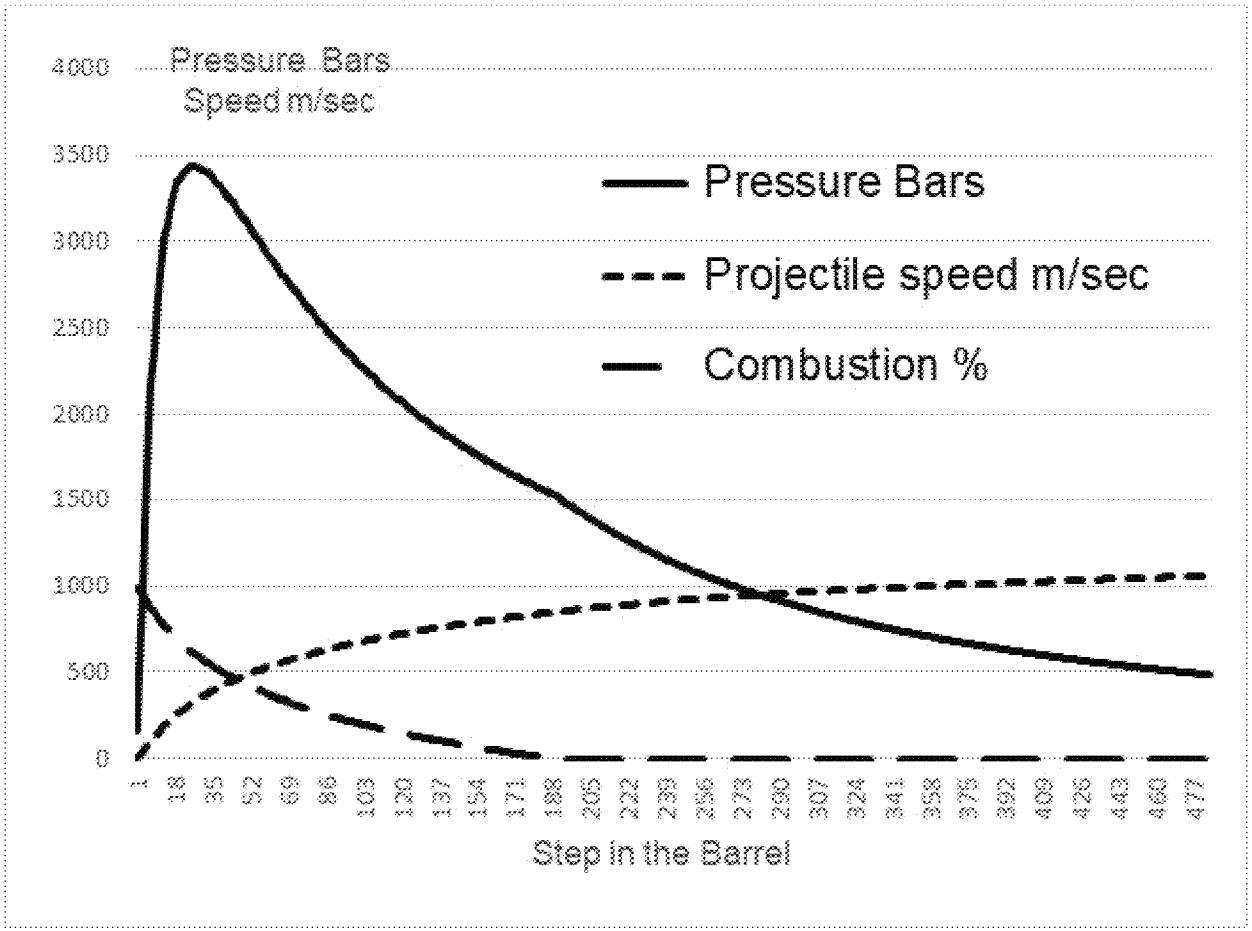
Fig. 7 (prior art)
FIG. 7 is a graphical representation of the pressure, velocity and combustion profiles of a simulated combustion process with a conventional projectile.

Similarly, FIGS. 5*a* and 5*b* depict the inner ballistic behavior of a 31% hollowed-out projectile. With an increase of 10% of the available volume and 4'000 bar matching specific energy increase of 18%, the projectile velocity increases by 30% and its kinetic energy by some 17%.

If thin walled Stainless-Steel casings, such as shown in FIG. 3, are used instead of standard brass casings an additional 12% of internal volume may be made available. A 25% hollowed-out projectile would offer a velocity increase of 27% and a kinetic energy increase of some 21% (see FIG. 6*a*) whereas a 31% hollowed-out projectile would provide a velocity increase of 32% and a kinetic energy increase of 21% (see FIG. 6*b*). A casing assembled from two or more parts as for instance illustrated in FIG. 3, may advantageously comprise a tubular sleeve 16 made of stainless steel that is thinner than conventional brass casings.

Conventional brass casings are made of a single piece brass part formed in a deep drawing process that leads to a tapered thickness side wall and a rounded internal surface on the base. By providing a two part stainless steel casing, the internal volume of the cartridge is increased by having a thinner base and thinner constant thickness walls of the tubular sleeve.

The internal volume gain, relative to the outer volume of the casing (which is defined by the caliber and chamber dimensions of the rifle and is thus invariable for a given weapon), by replacing a brass casing with a two part stainless steel casing, is in the range of up to 10% to 15%, and for most ammunition cartridges in a range of 11% to 13%, in particular about 12% as mentioned above.

This internal volume gain adds to the volume of the cavity 12 in the projectile 6 to achieve, for a given maximum allowable pressure during combustion of the propellant, a higher velocity projectile with higher kinetic energy than achievable with a conventional ammunition cartridge.

This increased performance is not due only to an increase in the amount of propellant, but importantly, also a reduction of the peak pressure due to the increased initial volume. At the beginning of combustion of the propellant, the increased internal volume in the casing and projectile reduces compression of the combusting gas in the very initial phase of ignition as the projectile exits the casing.

The inner ballistics values mentioned in FIGS. 4*a* to 6*b* have been derived from a mathematical model that has been validated in part with pressure/velocity measurements in reference weapons. Although the depicted values are simulations and may thus vary to some degree From experimental values, their tendencies are good indicators of the performance improvements that can be achieved.

Figure 9A:
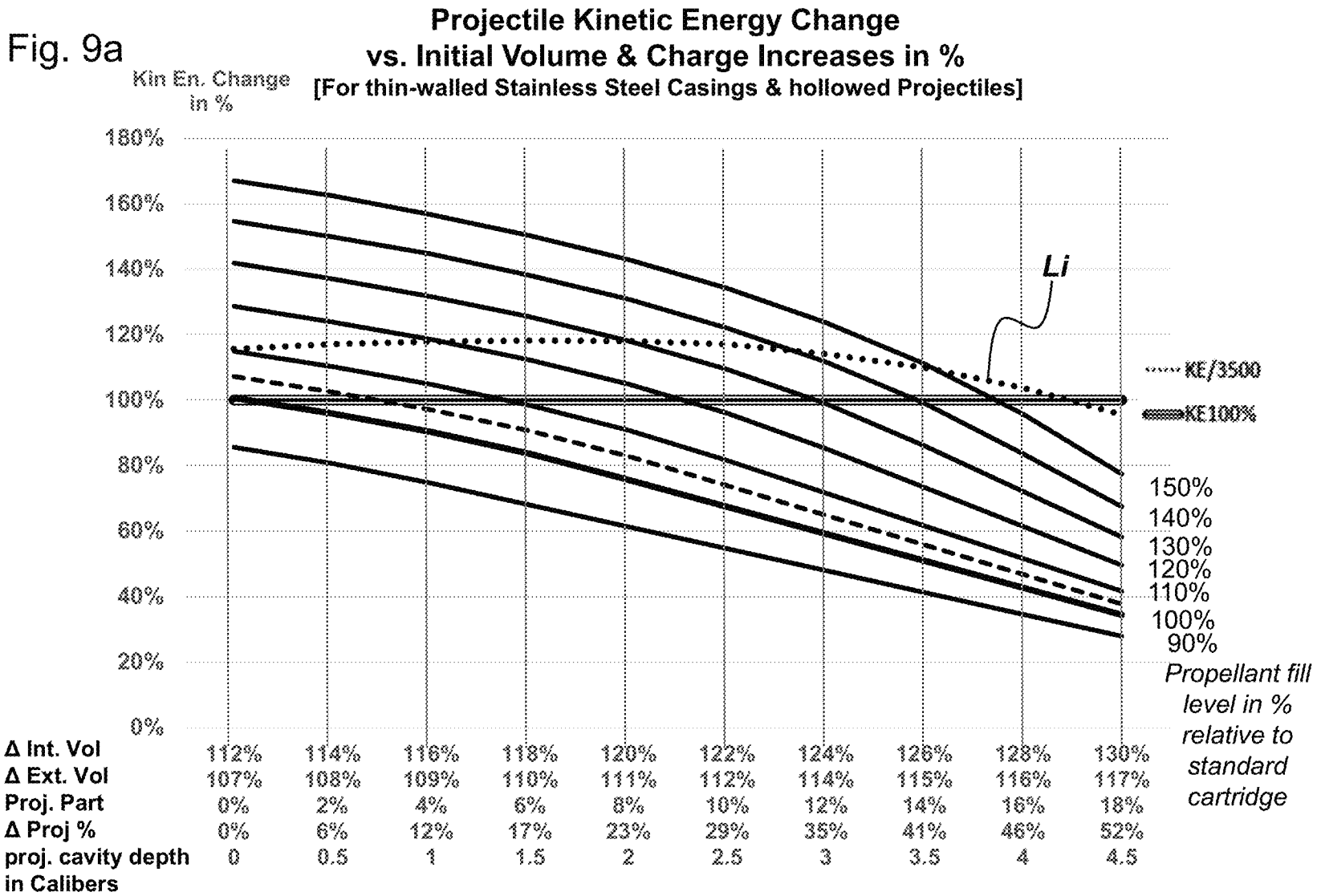
FIG. 9*a* illustrates a plot of kinetic energy change versus an increase in cartridge internal volume according to an embodiment of the invention compared to conventional ammunition cartridges with brass casings and for different propellant filling levels.
Figure 9B:
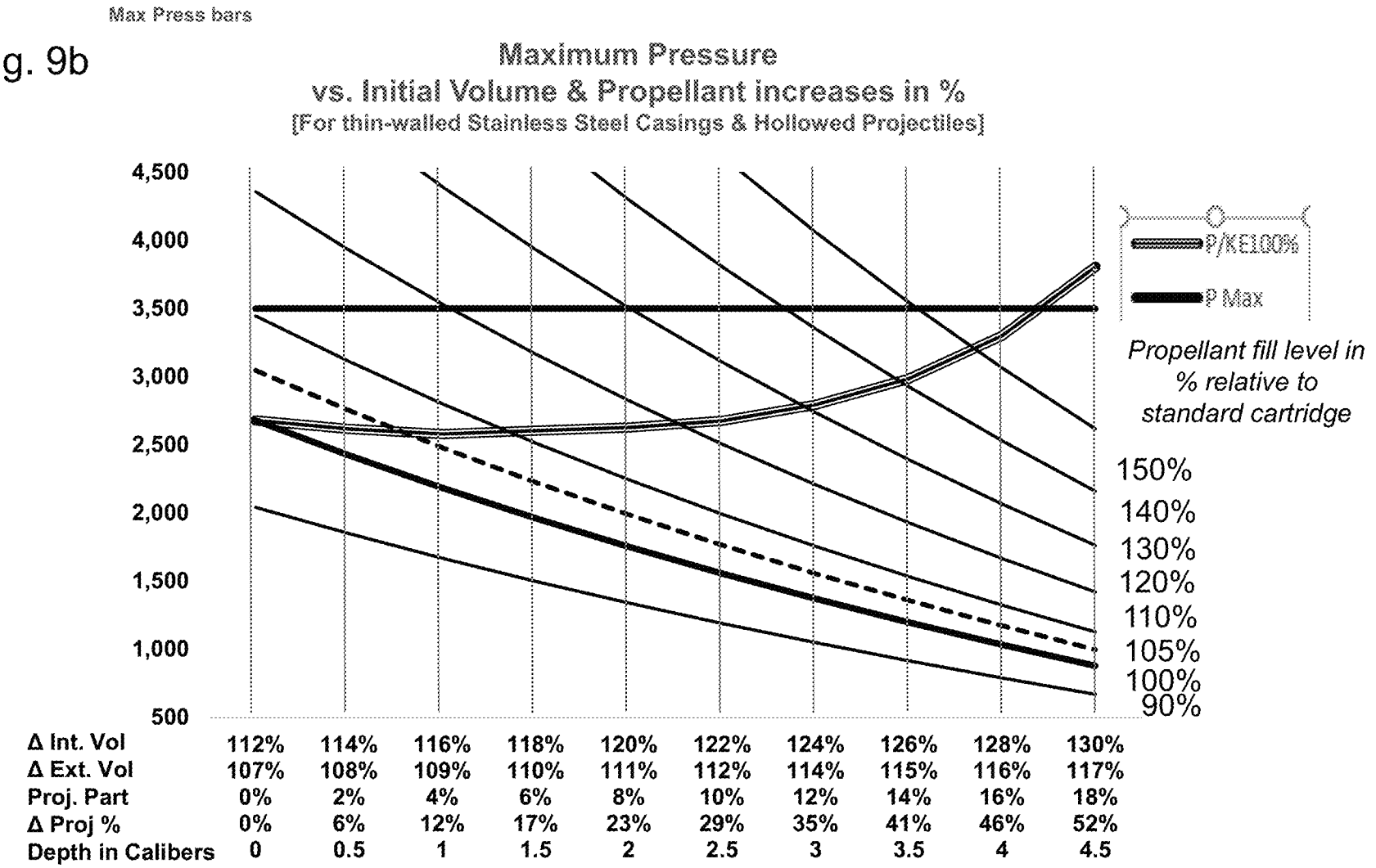
FIG. 9*b* illustrates a plot of maximum pressure achieved during combustion versus an increase in cartridge internal volume according to an embodiment of the invention compared to conventional ammunition cartridges with brass casings and for different propellant filling levels.
Figure 9C:
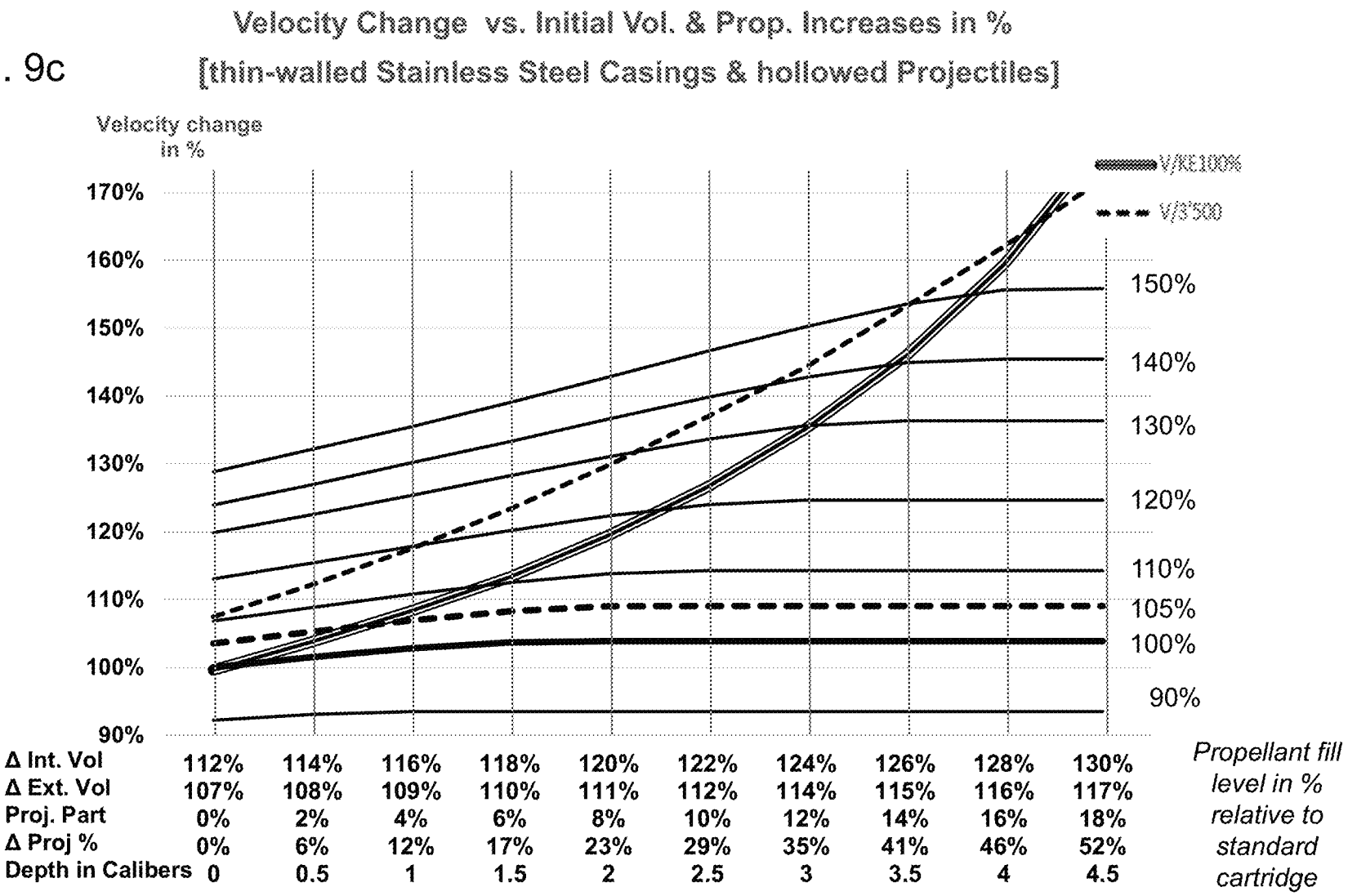

Referring to FIGS. 9*a* to 9*c*, plots showing the performance increase in an ammunition cartridge according to embodiments of the invention are illustrated. In these figures, a two-part stainless steel casing replacing a conventional brass casing for a given caliber and type of ammunition is illustrated. Various known conventional ammunition types for rifles illustrated in FIG. 13 for instance would have values close to the values illustrated in FIGS. 9*a* to 9*c* assuming a replacement of the brass casing with a stainless steel two-part casing according to embodiments of the invention and by replacing the projectile with a hollow projectile. The depth of the cavity measured as a function of the caliber is also indicated in rounded-up values because they are dependent on the diameter of the cavity. An important consideration in the increase in performance is the increased velocity illustrated in FIG. 9*c*. The greater the cavity in the projectile, the lower the mass, however the larger the internal volume and amount of propellant that can be used. The increase in velocity with a lower mass means that the projectile has a flatter flight profile and longer range, which also leads to increased shooting accuracy. This performance increase is of particular benefit for ammunition of types illustrated in FIG. 13 used for long barrel weapons (such as rifles and machine guns), with a ratio L/D of casing length L divided by casing diameter D in the range of 4.5 to 7, in particular 5 to 7.

The increase in internal volume compared to a conventional cartridge internal volume is indicated and also the increase in internal volume relative to the external volume which is a defined value that depends on the type of ammunition. In effect, the external volume forms a reference volume because it depends on the chamber size and the caliber that are constant or fixed values for a given weapon. Thus, whether producing a two-part stainless steel cartridge with hollow projectile or a conventional cartridge, the external shape and dimensions of the ammunition cartridge should be the same since they are defined by the weapon characteristics.

In these plots, the starting point is at 112% of increased internal volume over a conventional cartridge due to the casing alone, as mentioned above. The relative increase in internal volume measured with respect to the external volume is also indicated for reference, as 107%. The increase in internal volume above 112% relative to a conventional cartridge is due to the cavity 12 in the hollow projectile 6 causing an increase in the internal volume from 112% to 130% (107% to 117% when measured relative to the invariable external volume). The contribution of the cavity 12 in increasing the internal volume ranges thus from 0% to 18% on these plots.

As can be seen in FIGS. 9*b* and 9*c*, the increased internal volume compared to a conventional brass cartridge allows a greater amount of propellant charge which can vary from 110% to about 150% without exceeding a given peak pressure, here set at 3500 bars, as shown in FIG. 9*b*.

Referring to FIG. 9*a*, the increase in kinetic energy of the projectile is shown, here also as a function of the amount of propellant compared to a conventional casing as a function of the amount of hollowing part of the projectile. Since the hollowing out of the projectile 6 reduces its mass, for a given amount of propellant, the kinetic energy reduces. However, since there is a greater amount of propellant the kinetic energy may be increased up to about a 26% increase in the internal volume compared to a conventional internal volume of a conventional cartridge (or if measured with respect to the external volume about a 20% increase of internal volume relative to the external volume of a conventional cartridge).

The isobar line Li for 3500 bars in FIG. 9*a* is represented and shows that the optimum performance in this example is achieved between 114% and 122%, in particular between 116% and 120% relative to the internal volume of a conventional casing (or with respect to the external volume between 108% and 112%, in particular between 109% and 111%). The optimum performance in this example is at 18% increase in internal volume. The projectile in this example for optimum performance has a cavity volume V2 between 8% and 38%, preferably between 15% and 30% relative to the volume of a full projectile V1+V2. At the optimum, the cavity volume V2 is about 23% of the volume of a full projectile V1+V2, i.e. V2/(V1+V2)=23%.

It may be noted in FIG. 9*a* that the increase in kinetic energy that may be achieved is 20% compared to a conventional ammunition cartridge and is thus a significant improvement. In addition to the increased performance, the ammunition cartridges according to embodiments of the invention also have a reduced weight in view of the reduced volume of metal (casing and projectile) which is not offset by the increased amount of propellant which has a much lower density. Thus, lighter ammunition can be provided yet with higher performance.

FIG. 9*c* illustrates the increased velocity of the projectile obtained by different amounts of propellant charge and increasing internal volume compared to a conventional ammunition cartridge. The increase in velocity compensates for the decrease in mass for maintaining a high kinetic energy discussed in relation to the plot of FIG. 9*a*.

Figure 9D:
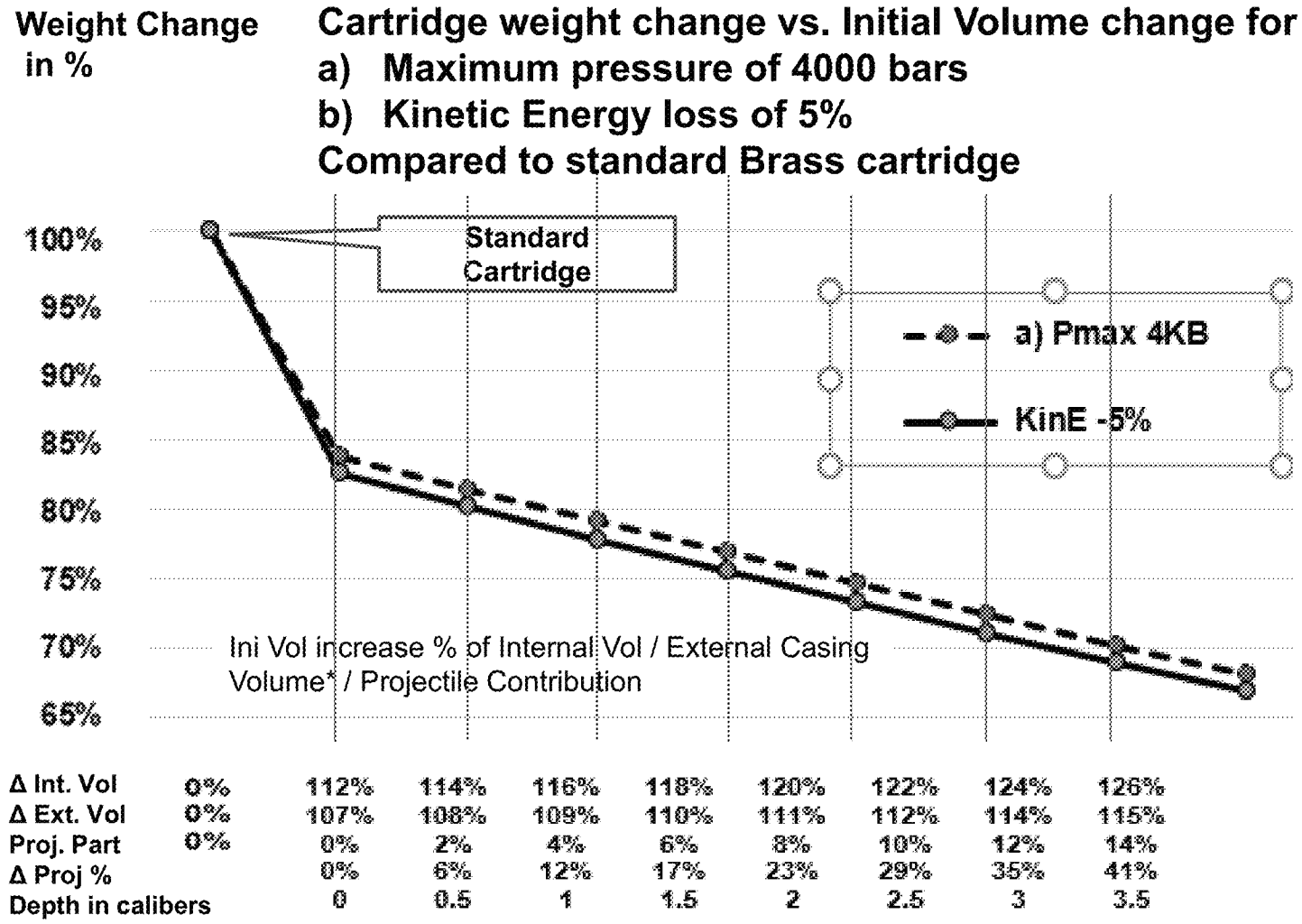
FIG. 9*d* illustrates a plot of change in mass of the ammunition cartridge versus an increase in cartridge internal volume according to an embodiment of the invention compared to conventional ammunition cartridges with brass casings.

Referring to FIG. 9*d*, the reduction in weight of the complete cartridge as a function of the increase in internal volume is shown, whereby in the region of optimum performance, namely about 18% increase internal volume relative to the internal volume of a conventional casing (or 10% increase in volume relative to the external volume of a conventional casing) there is a weight reduction of about 25%.

In addition to the aforementioned advantages, hollowed-out projectiles offer an improved stability because the distance between their centre of gravity (CG) and the centre of aerodynamic pressure (CP) is substantially smaller than in the case of a not hollowed-out projectile. The leverage of the aerodynamic pressure diminishes and the torque that can affect the projectile's flight is also reduced. The nutation angle of projectile is consequently reduced which means that the projectile's alignment remains closer to the flight trajectory.

Figure 8:
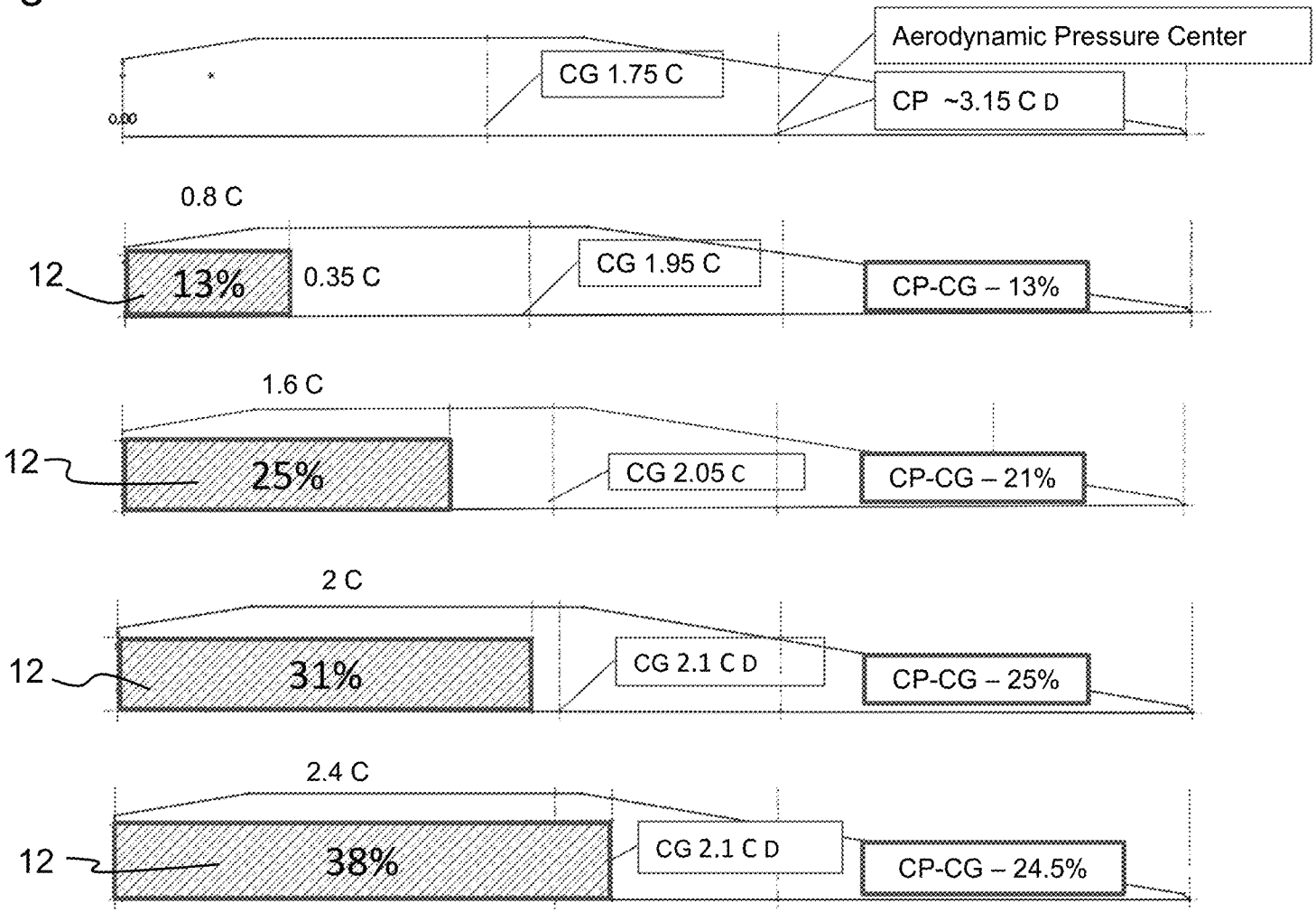
FIG. 8 is a schematic representation of projectile halves with different cavity volumes (depths) to illustrate the position of the centre of gravity (CG) and centre of aerodynamic pressure (CP)

In FIG. 8 projectiles with different cavity lengths are presented in terms of Calibers. A Caliber is usually defined as the diameter of the bore of a gun or the maximum diameter of the corresponding projectile. Using calibers as unit of measurement allows making descriptions independent of specific projectiles. FIG. 8 shows how the centre of gravity (CG) moves towards the tip of the projectile, and towards the centre of aerodynamic pressure (CP) as the cavity length is increased. A maximum reduction of the CG-CP distance of about 25% is reached with a cavity length of about two Calibers. For larger values the centre of gravity regresses away from the tip and in the case of projectiles where the centre portion is substantially fully hollowed out, the centre of gravity (CG) does not move significantly and there is little reduction in the CG-CP distance.

Thus, there is a significant advantage in having a projectile that has a cavity 12 with a volume V2 between 15% and 30% of the total projectile volume V1+V2 for both the increased performance and reduced weight as well as maintaining the stability of the projectile as discussed above in relation to FIG. 8.

Figures 2A, 2B, 2C:
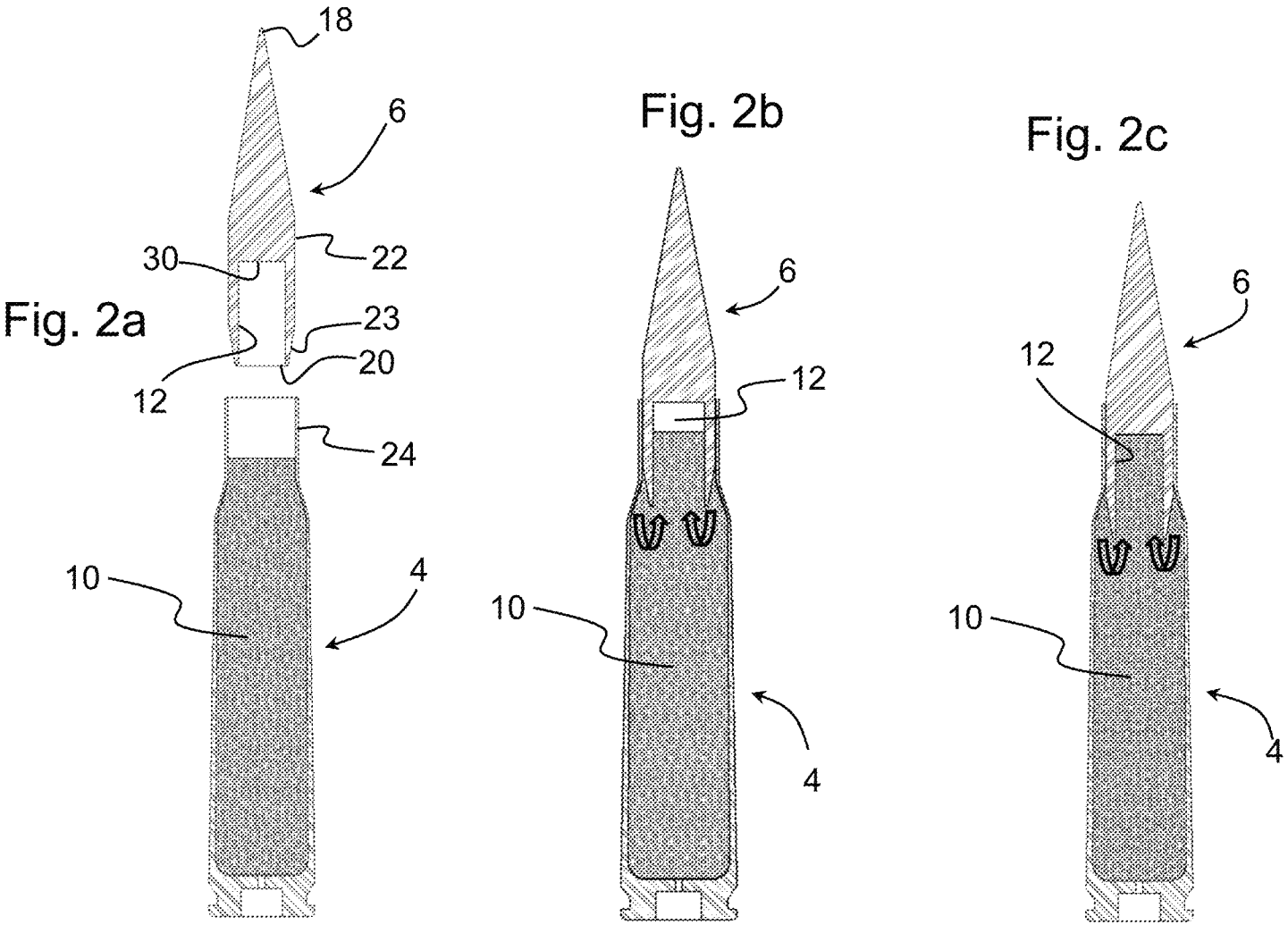
FIGS. 2*a* to 2*c* illustrate steps of assembly of the cartridge of FIG. 2.

FIGS. 2*a* to 2*c* illustrate assembly of a cartridge 4 with a propellant formed of granular powder 10 and a projectile 6 according to an embodiment of the invention. A larger than conventional quantity of propellant is filled in the casing to take into account the additional volume available inside the cavity 12 of the projectile 6. In the initial assembly step shown in FIG. 2*a* the casing is filled with propellant up to a portion of the casing neck portion 24. When the projectile 6 is inserted in the casing neck portion 24, as shown in FIG. 2*b*, granular propellant will flow into the projectile cavity 12 in a fluid like behavior. This process can continue with or without a little shaking of the cartridge until the projectile is normally inserted as shown in FIG. 2*c*. The resulting cartridge has a larger quantity of propellant than a conventional cartridge with a non-hollowed projectile, and offers also a larger initial combustion volume.

For embodiments comprising a pre-formed solid propellant charge, for instance as illustrated in FIG. 3, a leading portion 43 of the propellant charge may be shaped to insert partially (as shown) or fully into the cavity 12 of the projectile.

In a preferred embodiment the cavity may have a cylindrical or substantially cylindrical shape, however in other embodiments within the scope of the invention, the cavity may have other axisymmetric shapes such as conical, parabolic or elliptical, or may have non-axisymetric shapes such as a cavity with a polygonal cross-section. In yet other embodiments the cavity may comprise a plurality of cavities extending into the solid material body of the projectile. The term "cavity" as used herein shall thus, for simplicity, refer to one cavity if there is a single cavity, or to the combined plurality of cavities, if there are two or more cavities.

Projectiles with a cavity of 15% nominal volume or more extending into the trailing end represent an interesting ammunition improvement because they are fully compatible with existing weapons. For such weapons, the specific energy of the propellant would usually be increased in order to match the 4'000 bars tolerance. For new weapons, one could however contemplate other inner-ballistics variables and select them in order to achieve sufficient kinetic energy with a maximum pressure as low as possible. Reducing maximum pressure can relax the pressure tolerance and allow lighter weapons.

It may be noted that it is known to hollow-out the material of a projectile for flight tracing purposes, whereby the hollowed-out portion is filled with a pyrotechnical agent that evaporates after the projectile leaves the barrel to show the projectile's flight path. As the projectile remains filled until the projectile leaves the barrel, the removed mass of projectile material cannot contribute to the available initial volume.

Another concern with high speed, long range ammunition is related with the ability to train safely, in other words to find ranges long enough to avoid any casualty. As such ranges become difficult to find, there is a growing need for exercise ammunition with artificially limited ranges. The desire is to allow the external ballistics to deploy normally until a specified training limit distance where the projectile flight should become unstable and substantially reduce the trajectory of the projectile.

Another aspect of the present invention is thus to provide a means of destabilizing the projectile flight after a certain flight time.

In an embodiment illustrated in FIGS. 10*a* to 10*d*, the end-wall of the cavity 12 of the projectile 6 comprises a flight destabilizing device.

In this embodiment, at least one recess 34*a* is comprised in the end wall 30 and is filled with a consumable material 36*a*. There may be a second recess 36*b* filled with a non-consumable (inactive) material 36*b*, the two recesses for instance symmetrically arranged about the longitudinal centre axis A. An important aspect of the arrangement of the consumable material and the optional non-consumable material is that prior to ignition, the centre of gravity CG of the projectile 6 is positioned on the longitudinal axis A.

Therefore, depending on the volume of the recess 34*a*, the density of the consumable material 36*a*, and the position of the centre of gravity of the consumable material filling the recess 34*a* relative to the longitudinal axis A, the volume, position and presence of a non-consumable material may be adjusted to obtain a CG on the longitudinal axis.

In an embodiment, the consumable material may advantageously comprise or consist of a pyrotechnically active material filling the recess 34*a* and comprising an additional layer 36*c* of consumable material that is arranged around the longitudinal centre axis A in such a manner that the centre of gravity CG of the projectile remains on its centre longitudinal axis A even as the additional layer is thinned as it is being consumed. The additional layer is thus configured such that as it is consumed and thus changes in thickness, the centre of gravity of the additional layer remains centered on the longitudinal centre axis A.

Figures 10A, 10B, 10C, 10D:
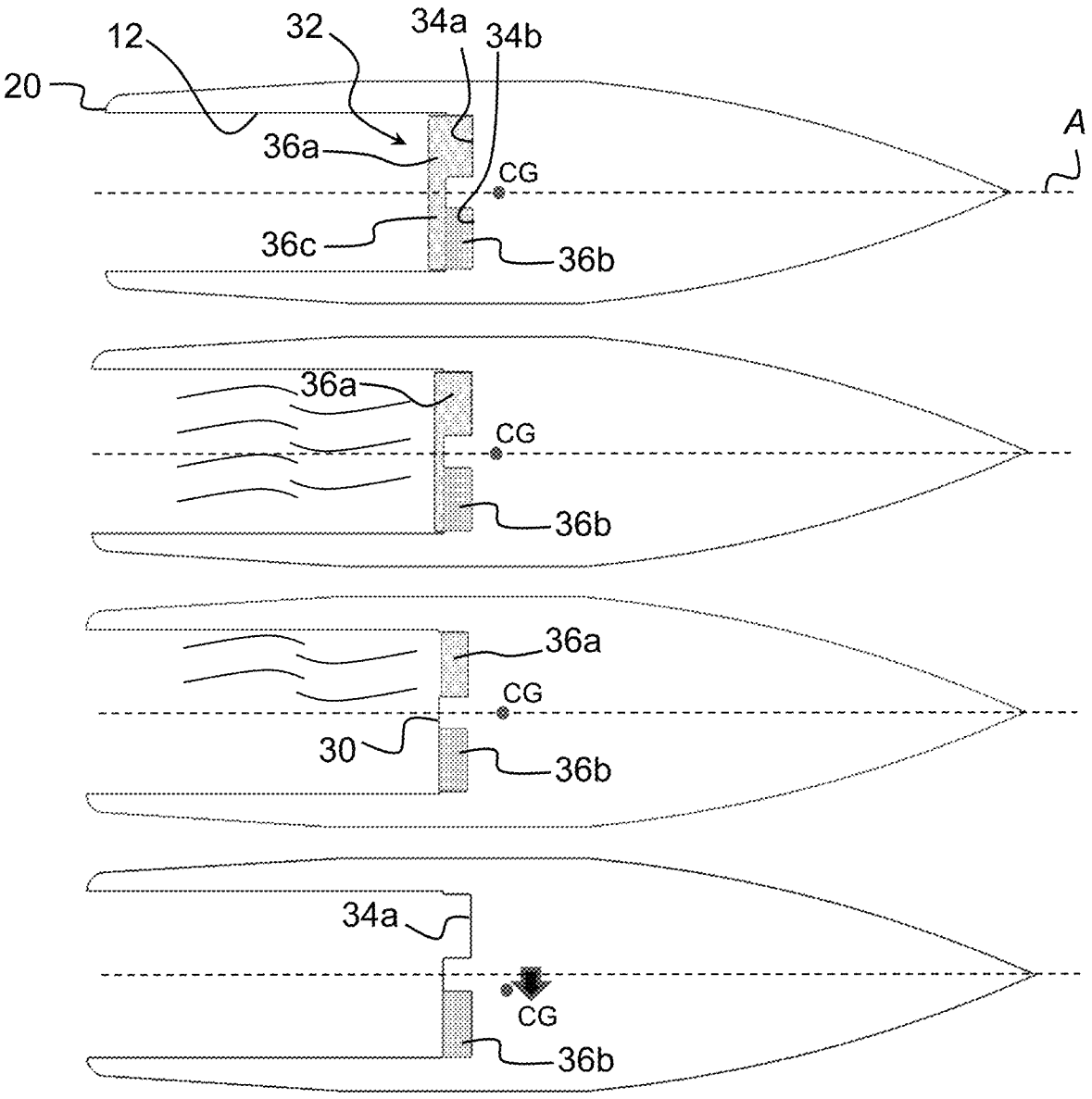
FIGS. 10*a*-10*d* are schematic cross-sectional views of a projectile with destabilizing device of an ammunition cartridge according to an embodiment of the invention, illustrating functioning of the destabilizing device to limit range of the projectile.

As soon as the projectile leaves the barrel, the additional layer of consumable pyrotechnically active material 36*c* evaporates as illustrated in FIG. 10*b*. After a certain time, the additional layer is consumed as illustrated in FIG. 10*c* and the consumable material 36*a* in the recess 34*a* subsequently evaporates or burns. The loss of material in the recess 34*a* introduces an imbalance that displaces the centre of gravity CG away from the projectile's longitudinal axis as shown in FIG. 10*d*. The moment of inertia is modified, the projectile tumbles and its flight is aerodynamically shortened. The quantity of consumable material, and its rate of evaporation or combustion can be configured such that tumbling occurs after a specific distance.

Figure 11:
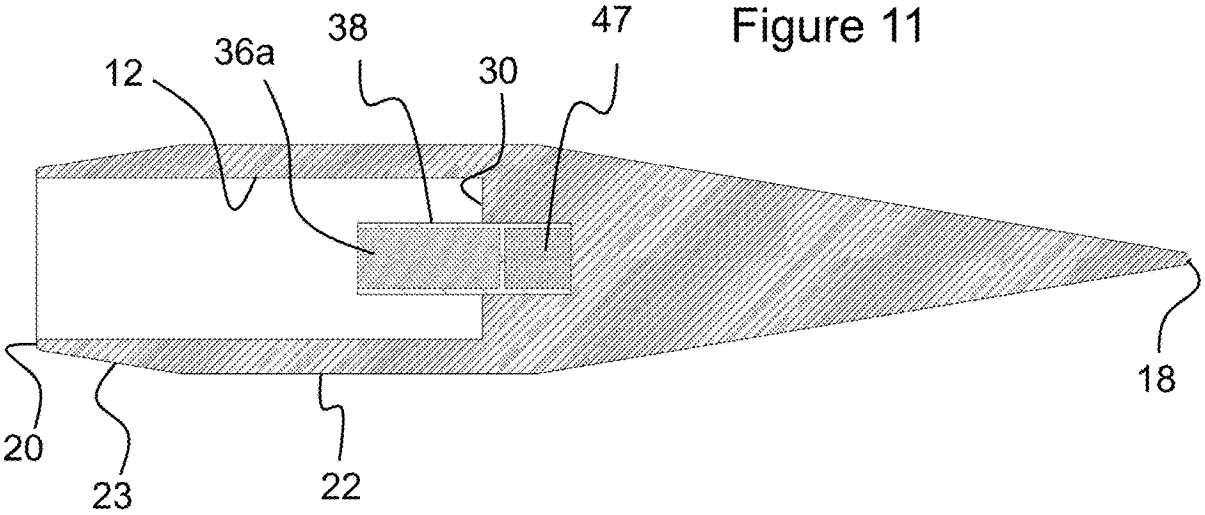
FIG. 11 is a schematic cross-sectional view of a projectile with destabilizing device of an ammunition cartridge according to another embodiment of the invention.

Other embodiments of destabilizing devices to produce flight instability at a specific distance may be provided. The pyrotechnical approach can release unevenly some material. It can also produce an explosion that generates a tumbling effect. For instance, in the embodiment illustrated in FIG. 11, a tracer type consumable material 36*a* located in the aft part of the destabilizer device 32 consumes until such time where it ignites an explosive mass 47 located in the front part of the destabilizer. The explosion detaches the destabilizer device 32 from the projectile 6 thus producing a destabilizing effect as it leaves the projectile.

Figure 12B:
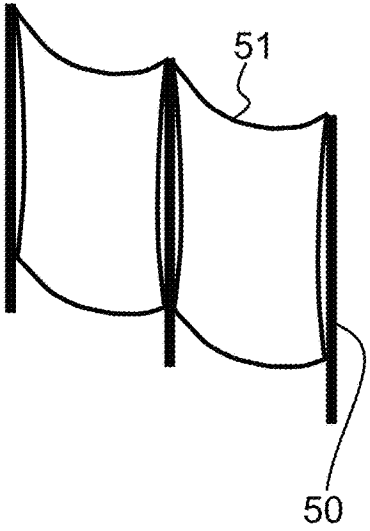
FIG. 12*b* is a schematic view of a portion of an electric field fence for triggering the destabilizing device of FIG. 12*a*
Figure 12A:
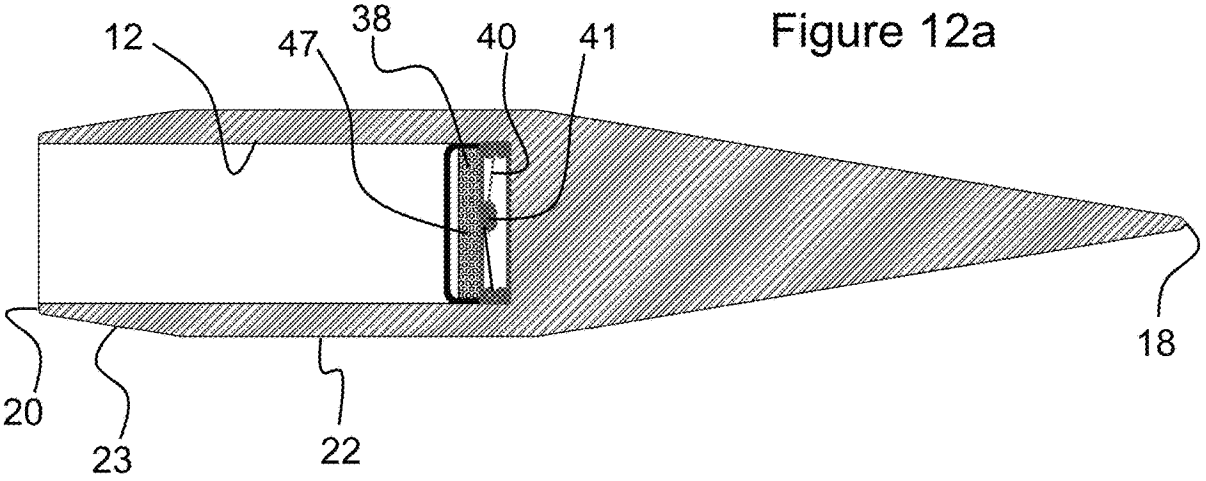
FIG. 12*a* is a schematic cross-sectional view of a projectile with destabilizing device of an ammunition cartridge according to another embodiment of the invention.

Another embodiment of a destabilizing device to produce flight instability at a specific distance may be externally actuated. In the embodiment illustrated in FIG. 12*a*, the destabilizer device 32 comprises an explosive charge 47 and an electric ignition device 41 that is triggered by an external magnetic field of a certain minimum specified intensity sufficient to generate an electrical current in the coil 40 of the electric ignition device 41 for igniting the explosive charge 47. The minimum specified or threshold intensity should be greater than the earth's magnetic field and magnetic fields generated by various common electrical and electronic equipment used by consumers and personnel that may be brought into proximity with an ammunition cartridge, to avoid inadvertent ignition.

The electric ignition device 41 may comprise a coil 40 in which an electric current is induced as the projectile passes through said magnetic field, to electrically ignite the explosive charge 47. The external magnetic field may for instance be generated by a fence with electric coils, for instance as schematically and partially represented in FIG. 12*b*, positioned at the desired range limitation distance of a training ground. The fence can be realized for instance with at least two or more poles 50 of a given height on which large electric coils 51 are suspended to generate the specified magnetic field.

LIST OF REFERENCED FEATURES

- Ammunition Cartridge 2
  - Casing 4
    - Base 14
      - Rim 27
      - Annular groove 29
    - Tubular sleeve 16
      - neck portion 24
      - major portion 25
      - base end 31
      - open neck end 33
  - Projectile 6
    - Tip 18
    - Centre body portion 22
    - Trailing end body portion 23
    - Trailing end 20
    - Cavity 12
      - End wall 30
    - Destabilizing arrangement 32
      - Recess(es) 34, 34*a*, 34*b*
      - Consumable material 36*a*
        - Pyrotechnically active material
      - Inactive material 36*b*
      - Holder 38
      - Explosive charge 47
  - Ignition device 8
    - Ignition charge 39*a*, 39*b*
    - Guide channel 37
    - Transmission pin 35
  - Propellant charge 10
    - loose Powder, granules,
    - Solid preform
      - Leading portion 43
        - Leading end 41
  - Magnetic/electromagnetic fence
    - poles 50
    - electric coils 51
- CG centre of gravity of the projectile
- CP centre of pressure of a projectile in flight
- A longitudinal centre axis of the projectile
- L length of the casing
- D maximum diameter of the casing

The invention claimed is:

1. An ammunition cartridge comprising a rigid casing including a tubular sleeve and a base closing an end of the casing, a projectile mounted at another end of the casing, a propellant charge contained inside the casing, and an ignition device, the projectile comprising a solid material body having a volume V1 extending between a tip to a trailing end, wherein the projectile further comprises a cavity that extends into the body from the trailing end and a flight destabilizing device mounted in the cavity.

2. The ammunition cartridge according to claim 1, wherein a volume V2 of the cavity is at least fifteen percent (15%) of a combined volume V1+V2 of the projectile solid material and cavity: $V2>0.15\times(V1+V2)$.

3. The ammunition cartridge according to claim 1, wherein, the flight destabilizing device comprises a consumable material configured to deplete as the projectile flies thus offsetting a centre of gravity (CG) of the projectile from a centre longitudinal axis (A) of the projectile.

4. The ammunition cartridge according to claim 3, wherein the consumable material is mounted in a recess in an end wall of the cavity, the recess being asymmetrically disposed with respect to the longitudinal centre axis (A).

5. The ammunition cartridge according to claim 4, wherein the consumable material comprises an additional layer arranged around the longitudinal centre axis in such a manner that the centre of gravity (CG) of the projectile remains on its centre longitudinal axis even as the additional layer is thinned as it is being consumed.

6. The ammunition cartridge according to claim 3, wherein the consumable material comprises or consists of a pyrotechnically active material.

7. The ammunition cartridge according to claim 1, wherein the flight destabilizing device comprises a consumable material and an explosive charge, the consumable material configured to deplete as the projectile flies until such time where it ignites the explosive charge to destabilize the projectile.

8. The ammunition cartridge according to claim 1, wherein the flight destabilizing device comprises an explosive charge, ignited by an electric ignition device comprising a conductive coil configured to induce an electric current in the presence of a magnetic field to detonate said explosive charge.

9. The ammunition cartridge according to claim 2, wherein the volume V2 of the cavity is at least twenty percent (20%) of the combined volume V1+V2 of the projectile solid material and cavity: $V2>0.20\times(V1+V2)$.

10. The ammunition cartridge according to claim 9, wherein the volume V2 of the cavity is less than thirty percent (30%) of the combined volume V1+V2 of the projectile solid material and cavity: $V2<0.30\times(V1+V2)$.

11. The ammunition cartridge according to claim 2, wherein a depth of the cavity from the trailing end is at least 1.5 calibers.

12. The ammunition cartridge according to claim 11, wherein the depth of the cavity from the trailing end is at most 2.5 calibers.

13. The ammunition cartridge according to claim 1, wherein the propellant fills an inside of the casing and extends at least partially into the cavity of the projectile.

14. The ammunition cartridge according to claim 13, wherein the propellant is in the form of loose granules or in a solid pre-form.

15. The ammunition cartridge according to claim 1, wherein the casing is made of at least two parts including a base and a tubular sleeve that are welded together.

16. The ammunition cartridge according to claim 15, wherein the tubular sleeve is made of stainless steel.

17. The ammunition cartridge according to claim 15, wherein the tubular sleeve is made of a sheet of metal rolled into a tube and welded along a seam.

18. The ammunition cartridge according to claim 15, wherein the tubular sleeve is made of an extruded tube of metal.

* * * * *